US010823434B2

(12) United States Patent
Shin et al.

(10) Patent No.: US 10,823,434 B2
(45) Date of Patent: Nov. 3, 2020

(54) DEHUMIDIFIER

(71) Applicant: SAMSUNG ELECTRONICS CO., LTD., Suwon-si (KR)

(72) Inventors: Moon Sun Shin, Suwon-si (KR); Kwon Jin Kim, Suwon-si (KR); Hyeong Joon Seo, Suwon-si (KR); Sung June Cho, Suwon-si (KR); Kang Ho Choi, Yongin-si (KR); Seong Ryeol Myeong, Suwon-si (KR); Jong Chul Ahn, Seoul (KR); Dong Yoon Lee, Suwon-si (KR); Jung Un Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 54 days.

(21) Appl. No.: 15/761,634

(22) PCT Filed: Sep. 22, 2016

(86) PCT No.: PCT/KR2016/010570
§ 371 (c)(1),
(2) Date: Mar. 20, 2018

(87) PCT Pub. No.: WO2017/052219
PCT Pub. Date: Mar. 30, 2017

(65) Prior Publication Data

US 2019/0049127 A1 Feb. 14, 2019

(30) Foreign Application Priority Data

Sep. 25, 2015 (KR) ..... 10-2015-0136844

(51) Int. Cl.
*F24F 3/14* (2006.01)
*F24F 1/02* (2019.01)
(Continued)

(52) U.S. Cl.
CPC ..... *F24F 3/14* (2013.01); *F24F 1/02* (2013.01); *F24F 6/02* (2013.01); *F24F 13/20* (2013.01);
(Continued)

(58) Field of Classification Search
CPC ..... F25D 17/065; F25D 17/062; F25D 21/14; F25C 1/24; F25C 1/08; F25C 5/005;
(Continued)

(56) References Cited

U.S. PATENT DOCUMENTS

2015/0184875 A1* 7/2015 Lee ..... F24F 13/222 62/93

FOREIGN PATENT DOCUMENTS

CN 2490948 Y 5/2002
CN 203869282 U 10/2014
(Continued)

OTHER PUBLICATIONS

Written Opinion of the International Searching Authority dated Dec. 14, 2016 in corresponding International Patent Application No. PCT/KR2016/010570, 20 pages.
(Continued)

*Primary Examiner* — Steve S Tanenbaum
(74) *Attorney, Agent, or Firm* — Staas & Halsey LLP

(57) ABSTRACT

A dehumidifier according to an aspect of the present disclosure includes: a body; and a water container mounted at an upper side of the body, wherein the body includes a seating part arranged at an upper side thereof and on which the water container is seated and a hollow connection port protruding upward from the seating part, and the water container includes a connection hole into which the connection port is inserted and a valve which opens the connection hole as the water container is mounted on the body. The dehumidifier prevents condensed water in the water container from leak-
(Continued)

ing through the connection hole in a state in which the water container is separated from the body.

6 Claims, 12 Drawing Sheets

(51) Int. Cl.
*F24F 13/22* (2006.01)
*F24F 13/20* (2006.01)
*F24F 6/02* (2006.01)

(52) U.S. Cl.
CPC ..... *F24F 13/22* (2013.01); *F24F 2003/1446* (2013.01)

(58) Field of Classification Search
CPC ..... F25C 2400/10; A47J 31/46; F16K 1/2092; F16K 15/023; F16K 15/031; F16K 27/0227; F24F 3/14; F24F 1/02; F24F 13/22; F24F 13/20; F24F 6/02; F24F 2003/1446
USPC ..... 62/93
See application file for complete search history.

(56) References Cited

FOREIGN PATENT DOCUMENTS

| | | |
|---|---|---|
| CN | 104748245 A | 7/2015 |
| JP | 2001-221470 | 8/2001 |
| JP | 2004-181279 | 7/2004 |
| KR | 10-2009-0087560 | 8/2009 |
| KR | 10-1524756 | 6/2015 |
| KR | 10-2015-0075749 | 7/2015 |

OTHER PUBLICATIONS

International Search Report dated Dec. 14, 2016 in corresponding International Patent Application No. PCT/KR2016/010570.
Written Opinion of the International Searching Authority dated Dec. 14, 2016 in corresponding International Patent Application No. PCT/KR2016/010570.
Chinese Office Action dated Jan. 6, 2020 from Chinese Patent Application No. 201680056031.6, 29 pages.

* cited by examiner

【Fig. 1】
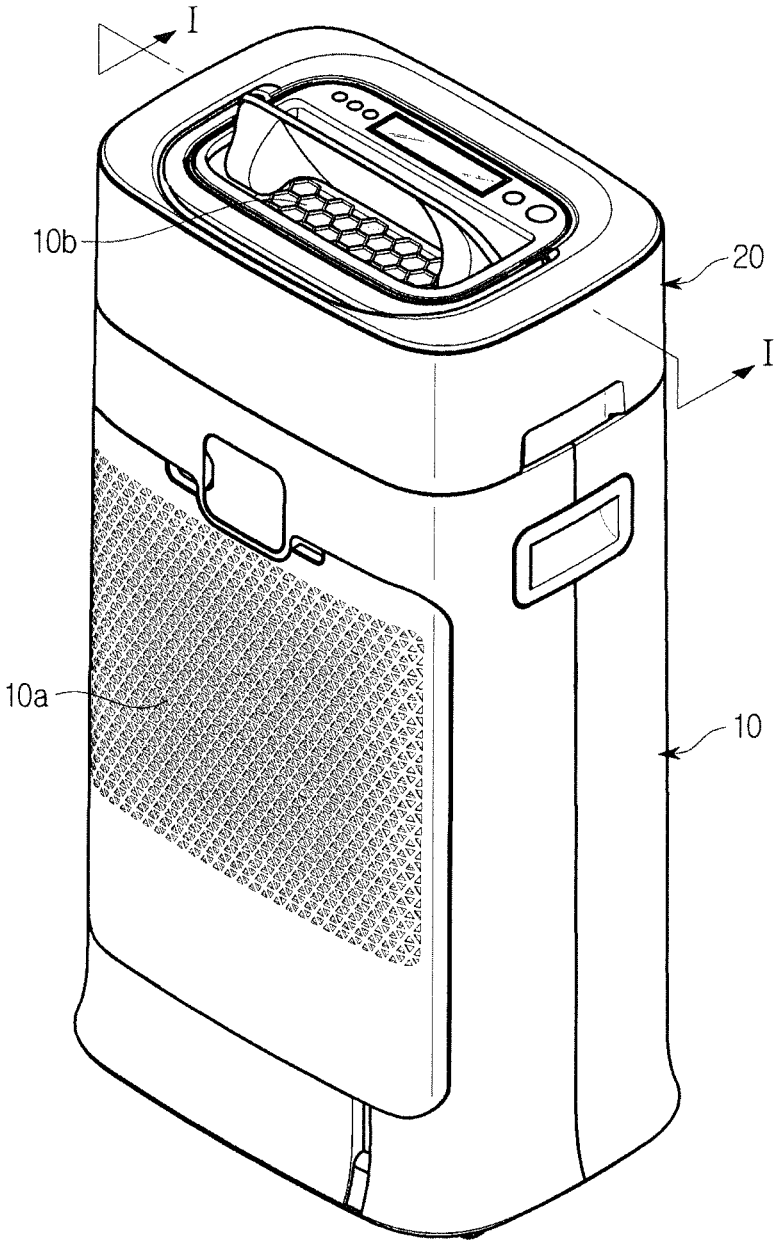

【Fig. 2】
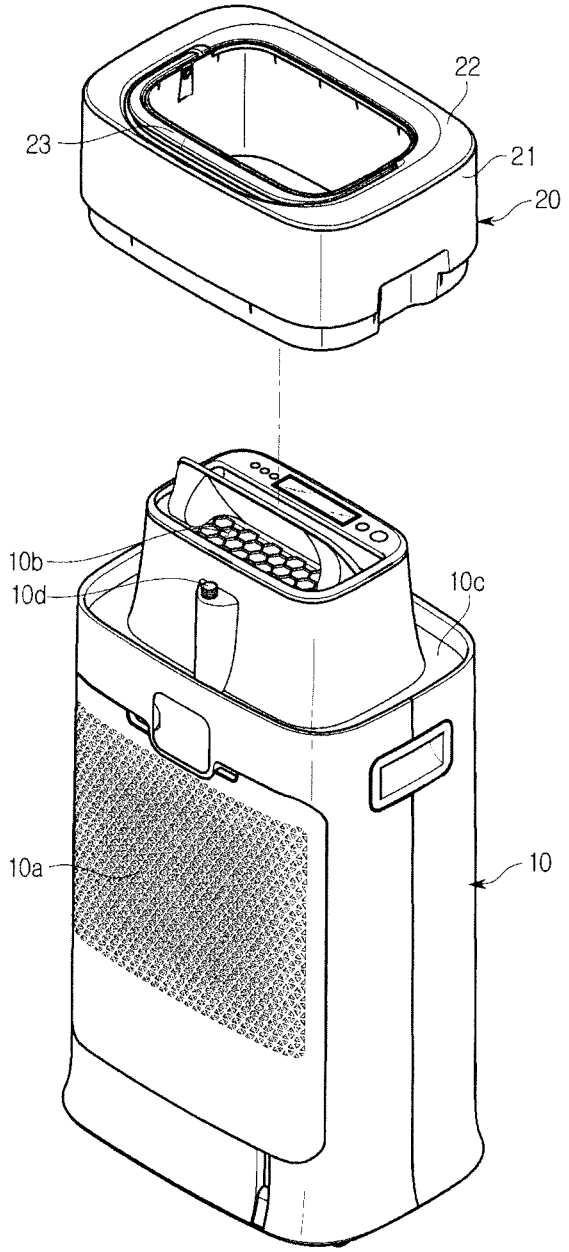

【Fig. 3】
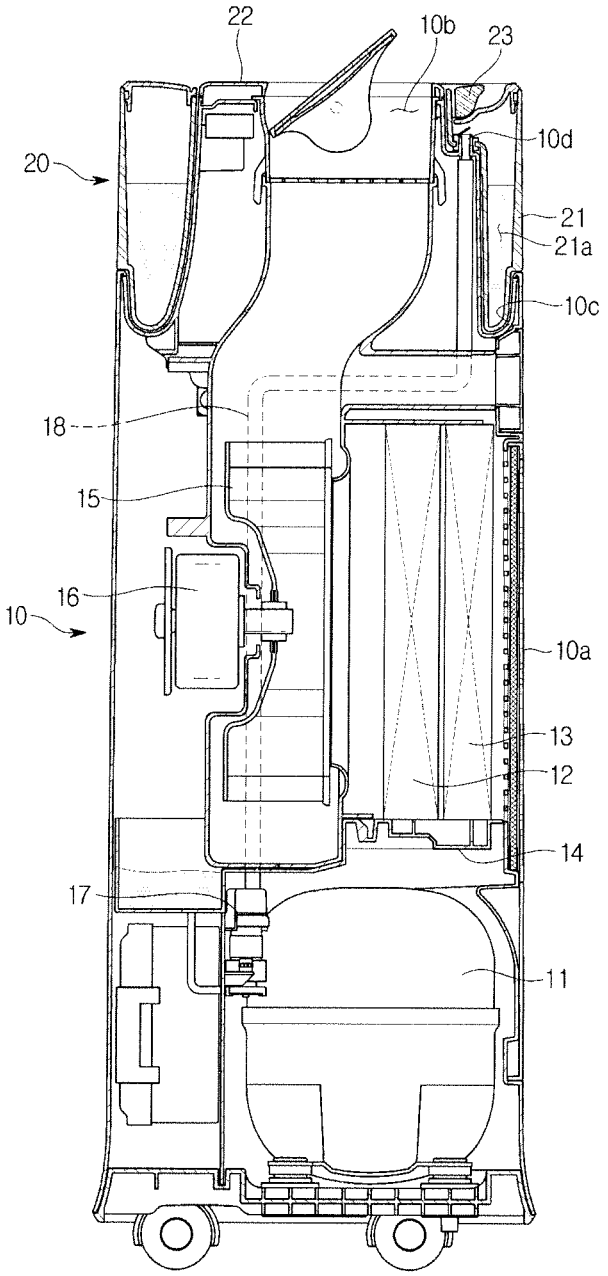

【Fig. 4】
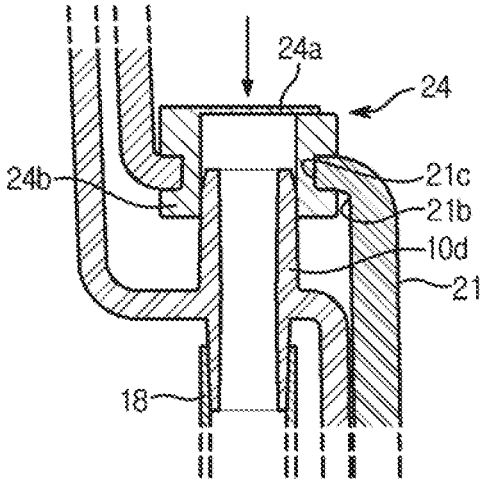

【Fig. 5】
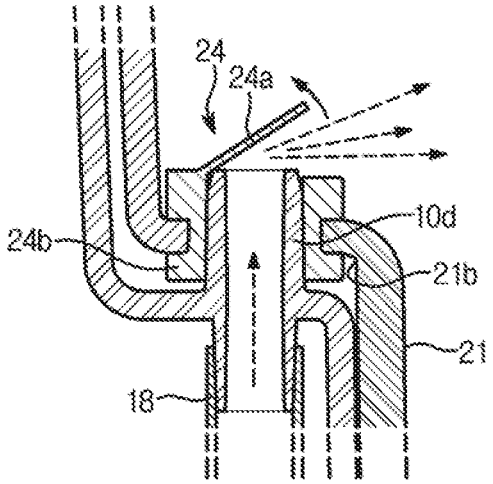

[FIG. 6]
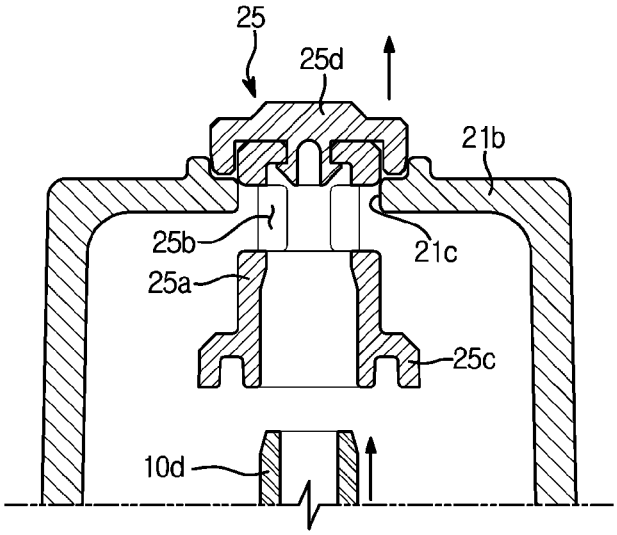

【Fig. 7】
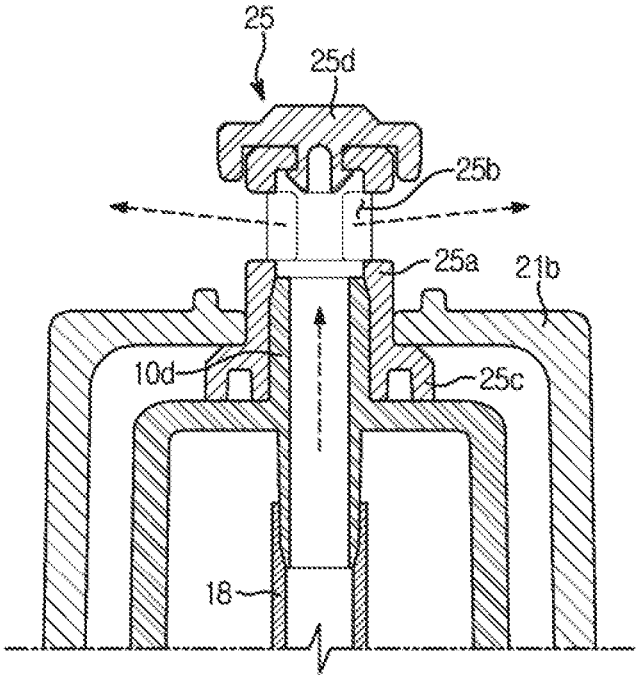

【Fig. 8】
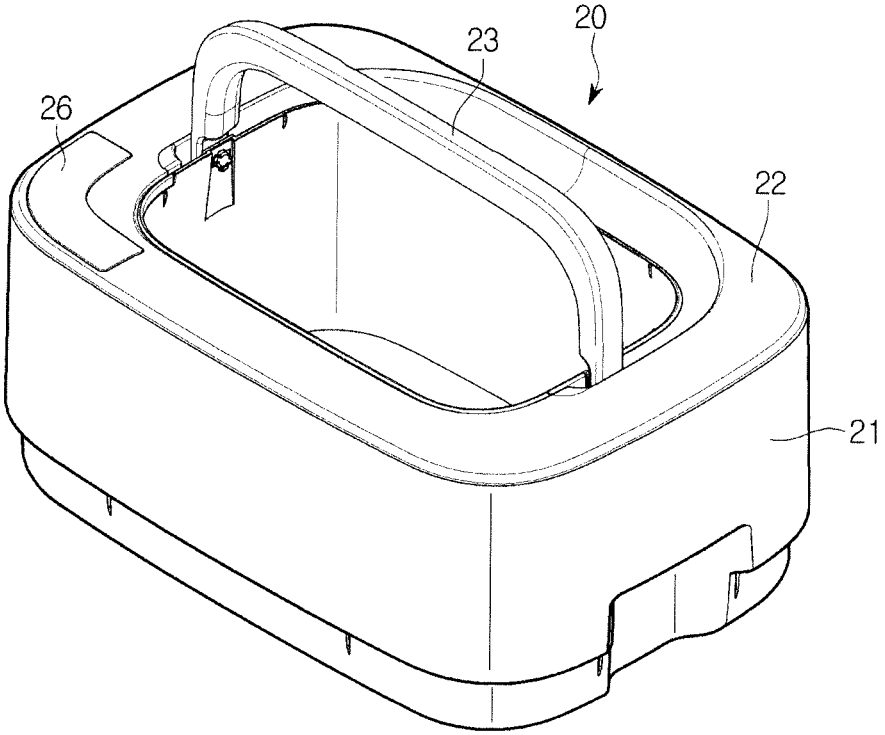

【Fig. 9】
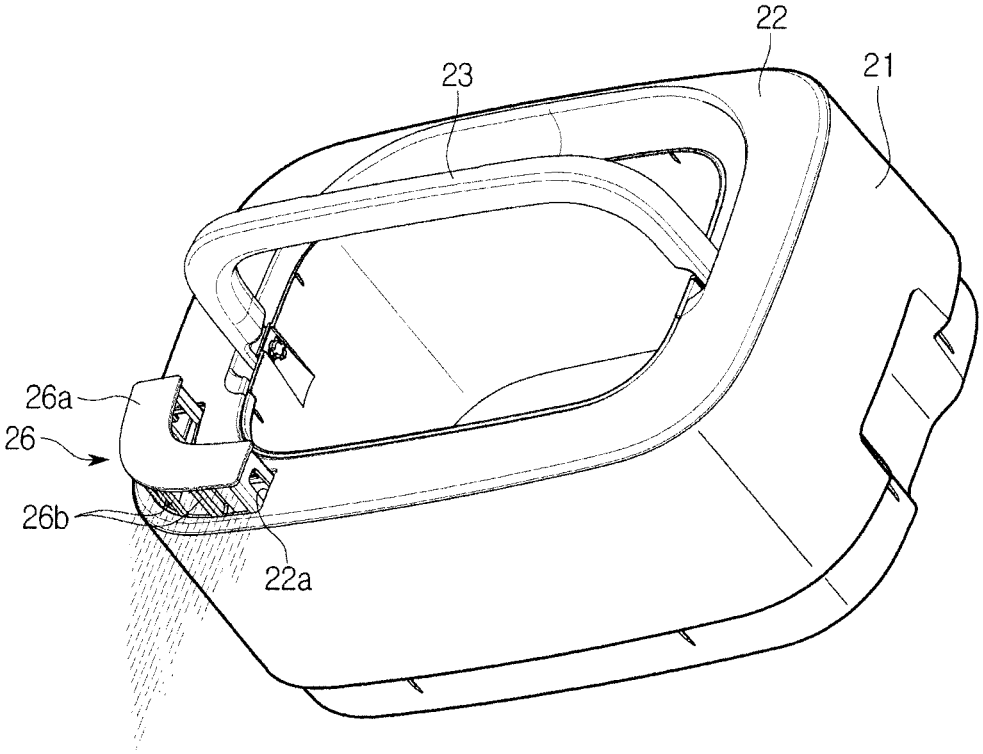

【Fig. 10】
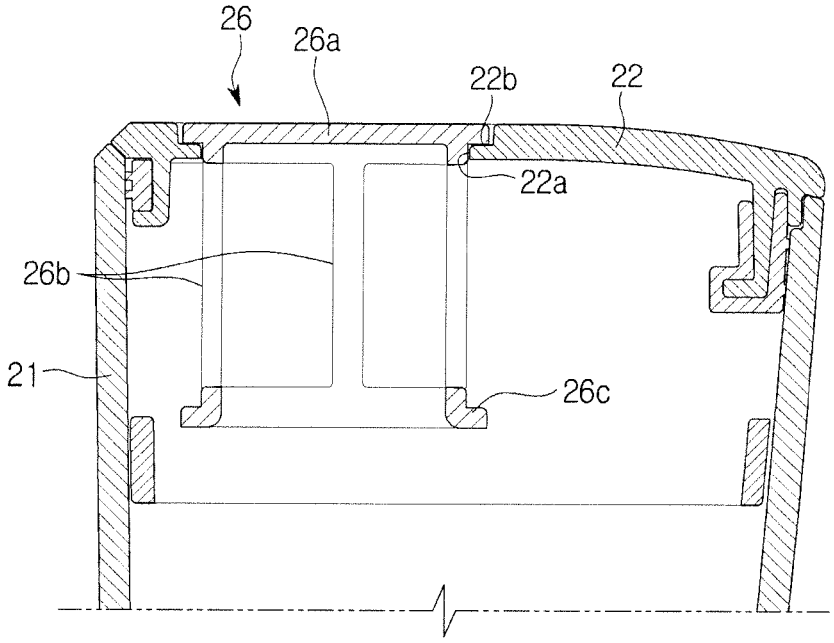

【Fig. 11】
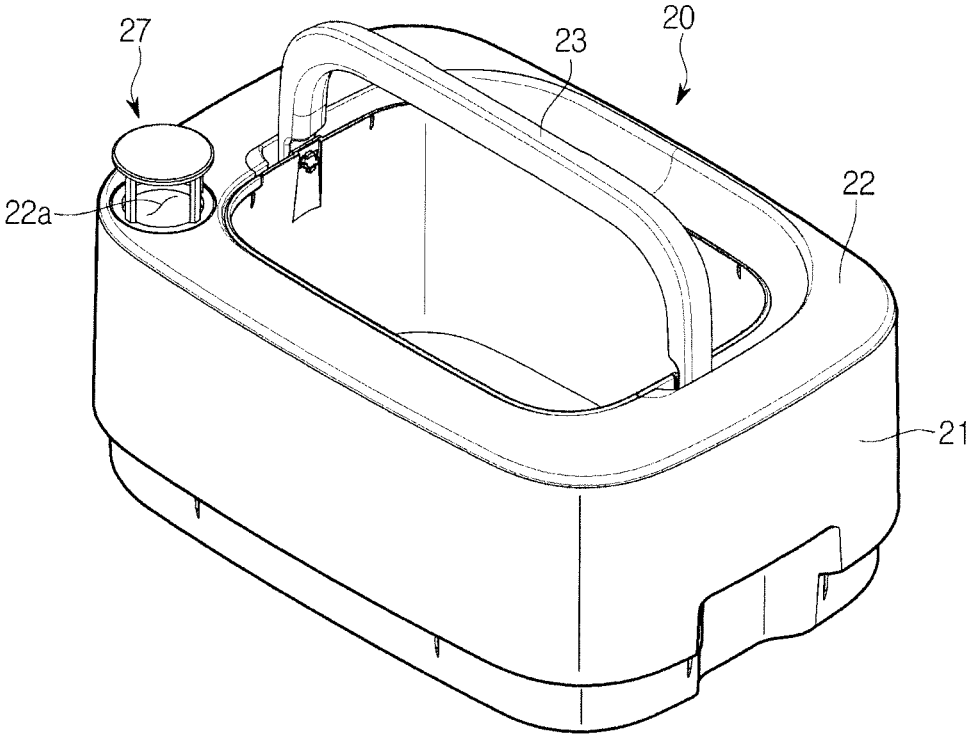

【Fig. 12】
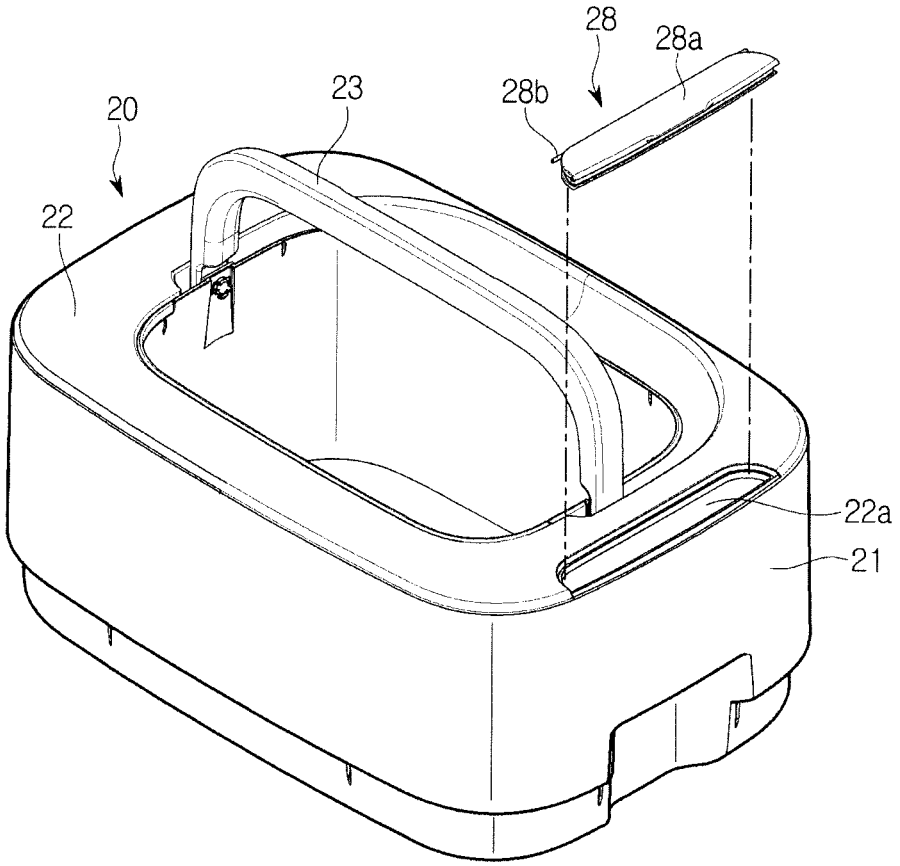

DEHUMIDIFIER

CROSS-REFERENCE TO RELATED APPLICATIONS

This application is a U.S. National Stage Application which claims the benefit under 35 U.S.C. § 371 of International Patent Application No. PCT/KR2016/010570 filed on Sep. 22, 2016, which claims foreign priority benefit under 35 U.S.C. § 119 of Korean Patent Application No. 10-2015-0136844 filed Sep. 25, 2015 in the Korean Intellectual Property Office, the contents of both of which are incorporated herein by reference.

TECHNICAL FIELD

The present disclosure relates to a dehumidifier disposed in an indoor space to adjust indoor humidity.

BACKGROUND ART

Generally, dehumidifiers are apparatuses for removing moisture in indoor air, and are classified into dry type dehumidifiers and cooling type dehumidifiers.

A dry type dehumidifier absorbs moisture in indoor air using a moisture absorbent, which is a chemical substance, to perform dehumidification, and a cooling type dehumidifier generates condensed water by cooling air through a refrigeration cycle included therein to perform dehumidification.

The cooling type dehumidifier includes a configuration including a body in which refrigeration cycle components, such as a compressor, a condenser, an expansion device, an evaporator, and the like, are accommodated and a water container configured to store condensed water generated by the evaporator.

Generally, the water container is disposed under the body so that the condensed water generated by the evaporator can be delivered to the water container due to weight thereof.

However, in the case in which the water container is disposed under the body as described above, when it is necessary to separate the water container from the body to drain the condensed water, a separation process of the water container is not easy since the water container is disposed under the body.

Accordingly, a method allowing a water container to be easily separated from a body by mounting the water container at an upper side of the body and delivering condensed water generated by an evaporator to the water container through a pump has recently been proposed.

DISCLOSURE

Technical Problem

One aspect of the present disclosure provides a dehumidifier in which a water container is mounted at an upper side of a body, and configured to prevent water from leaking through a connection hole in a state in which the water container is separated from the body.

Another aspect of the present disclosure provides a dehumidifier in which a water container is mounted on at an upper side of body, and configured to easily drain water in the water container.

Technical Solution

In accordance with one aspect of the present disclosure, a dehumidifier including a body, and a water container mounted on the body, wherein the body includes a seating part on which the water container is seated provided at an upper portion thereof, and a hollow connection port configured to protrude upward from the seating part, and the water container includes a connection hole into which the connection port is inserted, and a valve configured to open the connection hole when the water container is mounted on the body.

The dehumidifier may further include an opening and closing member including a valve portion formed of a material elastically transformed, wherein the valve portion includes a valve portion elastically transformed by an upper end of the connection port being inserted into the connection hole, and configured to be moved upward.

The opening and closing member may include a coupler provided with a hole into which the connection port is inserted and coupled to the connection hole, and the valve portion extends from one side of an upper end of the coupler and covers the hole of the coupler.

The valve may include a valve pipe installed on the connection hole to be vertically movable and provided with a hole into which the connection port is inserted, and the valve pipe includes a valve hole configured to communicate with the inside of the water container when the valve pipe is moved upward in an upper portion thereof.

The valve may include a stopper coupled with an upper end of the valve pipe and configured to restrict downward movement of the valve pipe to a certain level or less, and a hook protrusion configured to extend outward in a radial direction from a lower end of the valve pipe and restrict upward movement of the valve pipe to a certain level or less.

The water container may include a water storage portion provided in a lower portion thereof and configured to store condensed water, and a step portion provided in an upper portion of the water container to be stepped on the basis of the water storage portion, and the connection hole is provided in the step portion.

In accordance with another aspect of the present disclosure, a dehumidifier including a body, and a water container mounted on the body, wherein the water container includes a drain port provided in an upper surface thereof to drain water, and a plug configured to open and close the drain port.

The water container may include a water storage tank provided with a water storage portion configured to store water therein and having an open upper surface, and a cover installed on the water storage tank and configured to close the open upper surface of the water storage tank, and the drain port and the plug are provided in the cover.

The plug may include a plug portion configured to cover the drain port, a plurality of guides configured to extend downward from the plug portion and movably installed at the drain port, and hook portions connected to lower ends of the guides and configured to restrict the plug from moving upward by a distance greater than or equal to a certain level, and the water container includes a support protrusion provided at a portion adjacent to the drain port to be stepped and configured to support an outer portion of the plug portion.

The drain port and the plug portion may be formed in an L shape to correspond to each other.

The drain port and the plug portion may be formed in a circular shape to correspond to each other.

The plug may include the plug portion configured to cover the drain port, and a pair of hinge portions installed on an upper portion of the water container to be rotatable.

Advantageous Effects

Dehumidifier according to an aspect of the present disclosure can prevent water from leaking through a connection hole in a state in which a water container is separated from a body.

Further, since, in a dehumidifier according to an aspect of the present disclosure, a plug is provided on a drain port in an upper surface of a water container, a user can easily drain condensed water filled in the water container.

DESCRIPTION OF DRAWINGS

FIG. 1 is a perspective view illustrating a dehumidifier according to a first embodiment of the present disclosure.

FIG. 2 is a perspective view illustrating the dehumidifier according to the first embodiment of the present disclosure, in which a water container is separated.

FIG. 3 is a cross-sectional view of the dehumidifier according to the first embodiment of the present disclosure.

FIG. 4 and FIG. 5 are cross-sectional views illustrating a coupling portion of a connection port and a water container in the dehumidifier according to the first embodiment of the present disclosure.

FIG. 6 and FIG. 7 are cross-sectional views illustrating a coupling portion of a connection port and a water container in a dehumidifier according to a second embodiment of the present disclosure.

FIG. 8 is a perspective view illustrating a dehumidifier according to a third embodiment of the present disclosure, in which a drain port is closed by a plug.

FIG. 9 is a perspective view of the dehumidifier according to the third embodiment of the present disclosure, in which the plug is moved and a drain port is opened.

FIG. 10 is a cross-sectional view of the dehumidifier according to the third embodiment of the present disclosure, in which the drain port is closed by a plug.

FIG. 11 is a perspective view illustrating an installation state of a plug applied to a dehumidifier according to a fourth embodiment of the present disclosure.

FIG. 12 is an exploded perspective view illustration an installation state of a plug applied to a dehumidifier according to a fifth embodiment of the present disclosure.

MODES OF THE DISCLOSURE

Hereinafter, a dehumidifier according to one embodiment of the present disclosure will be described in detail with reference to the drawings.

As shown in FIG. 1, a dehumidifier according to a first embodiment of the present disclosure includes a body 10 forming an exterior of the dehumidifier and including refrigeration cycle components therein, and a water container 20 mounted on an upper side of the body 10 and configured to store condensed water generated by dehumidification.

A refrigeration cycle included in the body 10 includes a compressor 11 configured to compress a refrigerant, a condenser 12 in which the refrigerant compressed by the compressor 11 exchanges heat with indoor air and is cooled to be condensed, an expansion device (not shown) configured to decompress and expand the refrigerant condensed by the condenser 12, and an evaporator 13 in which the refrigerant decompressed and expanded by the expansion device suctions heat from air introduced into the body 10.

Further, the body 10 includes air suction ports 10*a* provided in one side surface of the body 10 and configured to suction indoor air so that the indoor air is introduced into the body 10, and discharge ports 10*b* provided in an upper surface of the body 10 and configured to discharge dehumidified air to an indoor space.

The evaporator 13 and the condenser 12 described in the embodiment are sequentially disposed on an inner side of the air suction ports 10*a* such that indoor air suctioned through the air suction ports 10*a* is cooled by passing through the evaporator 13 and is reheated by passing through the condenser 12.

A seating part 10*c* on which the water container 20 is seated is provided at an upper portion of the body 10. In the embodiment, the water container 20 is formed in an approximately rectangular ring shape, and the seating part 10*c* is formed in an approximately rectangular ring shape to correspond to the water container 20.

Further, the body 10 includes a blowing fan 15 configured to be rotated to generate a suction force so that indoor air is introduced into the body 10 to be dehumidified and a blowing force so that the indoor air is discharged to an indoor space, and a driving motor 16 configured to generate a rotational force to rotate the blowing fan 15.

Further, the body 10 includes a drain pan 14 disposed under the evaporator 13 and configured to collect condensed water which falls from the evaporator 13, a pump 17 connected to the drain pan 14 and configured to pump the condensed water from the drain pan 14, and a delivery pipe 18 configured to deliver the condensed water pumped by the pump 17 to the water container 20.

Accordingly, when the blowing fan 15 is rotated by the driving motor 16, indoor air is introduced into the body 10 through the air suction ports 10*a* by the suction force generated by the blowing fan 15. Since the evaporator 13 and the condenser are sequentially disposed on the inner side of the air suction ports 10*a*, the air introduced into the body 10 is cooled by passing through the evaporator 13 and is reheated by passing through the condenser 12. The air dehumidified by passing through the evaporator 13 and the condenser 12 also passes through the blowing fan 15 and is discharged to an indoor space through the discharge ports 10*b*.

As described above, in a process in which air is cooled by the evaporator 13, since moisture included in the air is condensed on a surface of the evaporator 13, condensed water is generated in the evaporator 13. The condensed water generated in the evaporator 13 falls due to a weight thereof and is collected on the drain pan 14 disposed under the evaporator 13, and the condensed water collected on the drain pan 14 is pumped by the pump 17 and delivered to the water container 20 through the delivery pipe 18.

The water container 20 includes a water storage tank 21 forming a water storage portion 21*a* configured to store condensed water therein and having an open upper surface, a cover 22 coupled to an upper portion of the water storage tank 21 and configured to cover an upper side of the water storage tank 21, and a handle 23 rotatably installed in the water storage tank 21 so that a user may easily install the water container 20 on the body 10 and separate the water container 20 from the body 10.

In the embodiment, the water container 20 is formed in an approximately rectangular ring shape. Accordingly, the water storage tank 21 and the cover 22 forming the water container 20 are also formed in an approximately rectangular ring shape. The handle 23 is rotatably installed on an inner wall of the water container 20 formed in the rectangular ring shape.

A connection port 10*d* inserted into a connection hole 21*c* of the water container 20, which will be described below, is provided on the seating part 10*c* of the body 10 so that the condensed water may be delivered to the water container 20. The connection port 10*d* is formed in a hollow pipe shape having a lower end protruding into the body 10 and connected to the above-described delivery pipe 18 and an upper end protruding upward from the seating part 10*c* and inserted into the connection hole 21*c*.

The above-described water storage portion 21*a* is provided in a lower portion of the water container 20, and a step portion 21*b* is provided in an upper portion of the water container 20 to be stepped on the basis of the water storage portion. The step portion 21*b* is provided at a location corresponding to the connection port 10*d*, and the upper end of the connection port 10 is inserted into the connection hole 21*c* when the water container 20 is seated on the seating part 10*c*.

Further, as shown in FIGS. 4 and 5, the water container 20 includes a valve 24 which allows the condensed water to be delivered through the connection hole 21*c* when the water container 20 is seated on the seating part 10*c*, and prevents the condensed water from leaking from the water container 20 through the connection hole 21*c* when the water container 20 is separated from the body 10.

In the embodiment, the valve 24 includes a coupler 24*b* provided with a hole, into which the connection port 10*d* is inserted, and installed on the connection hole 21*c*, and a valve portion 24*a* configured to extend from one side of an upper end of the coupler 24*b* and cover an upper side of a hole provided in the coupler 24*b*. In the embodiment, the coupler 24*b* and the valve portion 24*a* of the valve 24 are integrally formed of an elastically transformable material.

Accordingly, the coupler 24*b* is elastically transformed and forcibly fitted into the connection hole 21*c*, and the valve portion 24*a* is elastically transformed by an external force and can move upward. Accordingly, the valve portion 24*a* maintains a state in which the hole of the coupler 24*b* is closed when the water container 20 is separated from the body 10, and the valve portion 24*a* is elastically transformed in an upward direction by an upper end of the connection port 10*d* inserted into the hole of the coupler 24*b* when the water container 20 is seated on the seating part 10*c* of the body 10, and thus the condensed water may be delivered to the water container 20 because the hole of the coupler 24*b* is opened.

Hereinafter, a valve applied to a dehumidifier according to a second embodiment of the present disclosure will be described in detail with reference to the drawing.

As shown in FIGS. 6 and 7, a valve 25 includes a valve pipe 25*a* provided with a hole, into which a connection port 10*d* is inserted, and installed on a connection hole 21*c* to be vertically movable, valve holes 25*b* provided in an upper portion of the valve pipe 25*a* and configured to communicate with the inside of a water container 20 when the valve pipe 25*a* is moved upward, a stopper 25*d* coupled with an upper end of the valve pipe 25*a* and supported by a portion of a step portion 21*b* adjacent to the connection hole 21*c* to restrict downward movement of the valve pipe 25*a* to a certain level or less, and hook protrusions 25*c* configured to extend in a radial direction from a lower end of the valve pipe 25*a* and restrict upward movement of the valve pipe 25*a* to a certain level or less.

Accordingly, when the water container 20 is separated from a body 10, the valve pipe 25*a* maintains a state in which it is downwardly moved by a weight thereof. In this case, the stopper 25*d* serves to prevent the valve pipe 25*a* from being moved downward by a distance greater than or equal to the certain level, and prevent condensed water in the water container 20 from leaking through the connection hole 21*c*.

In this state, since the valve hole 25*b* and the water container 20 do not communicate with each other, the condensed water in the water container 20 is prevented from leaking through the connection hole 21*c*.

When the water container 20 is seated on a seating part 10*c* of the body 10, the connection port 10*d* is inserted into the hole in the valve pipe 25*a*, and thus the valve pipe 25*a* is moved upward. Since the valve hole 25*b* provided in the upper portion of the valve pipe 25*a* is disposed inside the water container 20 as the valve pipe 25*a* is moved upward, the inside of the water container 20 and the valve hole 25*b* communicate with each other. Accordingly, the condensed water delivered through the connection port 10*d* may be delivered to the water container 20 through the valve hole 25*b*.

Further, as shown in FIGS. 8 to 10, the water container 20 includes a drain port 22*a* allowing a user to drain condensed water stored in the water container 20 outward, and a plug 26 configured to open and close the drain port 22*a*.

In the embodiment, the drain port 22*a* is formed in an approximate L shape in the cover 22, and the plug 26 is formed in an approximate L shape to correspond to the cover 22. Further, the cover 22 is provided with support protrusions 22*b* stepped on the basis of portions of the drain port 22*a* adjacent to the support protrusions 22*b* and configured to support an outer portion of the plug 26.

The plug 26 includes a drain plug portion 26*a* configured to open and close the drain port 22*a*, a plurality of guides 26*b* configured to extend downward from an outer portion of the drain plug portion 26*a* and disposed to be spaced apart from each other, and hook portions 26*c* configured to connect lower ends of the guides 26*b* and forming an approximate L ring shape to be engaged with an adjacent portion of the drain port 22*a* and prevent separation of the plug 26 from the water container 20. In the embodiment, the guides 26*b* are supported by the drain port 22*a* to be vertically movable.

Accordingly, as shown in FIG. 9, when the user tilts the water container 20 so that the condensed water in the water container 20 applies water pressure to the plug 26, the plug 26 is pushed upwardly out and opens the drain port 22*a*. Further, when the user places the water container 20 in a horizontal state, the plug 26 is moved downward by a weight thereof and closes the drain port 22*a*.

That is, the user may easily drain the condensed water filled in the water container 20 by tilting the water container 20 toward the drain port 22*a* without directly applying force to the plug 26.

In the embodiment, although the plug 26 is formed in an approximate L shape, the plug 26 is not limited thereto, and according to a fourth embodiment of the present disclosure, each of a drain port 22*a* and a plug 27 may be formed in a circular shape, as shown in FIG. 11.

In a third embodiment and the fourth embodiment, although the plug 25 or 26 is movably installed on the drain port 22*a* and pushed upwardly out by the water pressure applied to the plug portion 26*a* to open the drain port 22*a* when the user tilts the water container 20, the plug 25 or 26 is not limited thereto, and, as shown in FIG. 12, according to a fifth embodiment of the present disclosure, a plug 28 includes a plug portion 28*a* and hinge portions 28*b* provided on both sides of the plug portion 28*a*, and thus the plug 28 may be rotatably installed in the cover 22 by the hinge portions 28*b*. In this case, the plug 26 is rotated around the hinge portions 28*b* to open and close the drain port 22*a*. The plug 28 may be opened through a method in which the plug 28 is opened by water pressure and a method in which the plug 28 is rotated by directly receiving force from a user.

In the embodiments, although the water container 20 is formed in an approximately rectangular ring shape, the water container 20 is not limited thereto, and the valve and the plug disclosed in the embodiments may be wholly applied to water containers 20 having various other shapes and installed on the body 10 regardless of a shape of the water container 20.

Although the technical spirit of the above present disclosure has been described through the various embodiments, the scope of the present disclosure is not limited to the embodiments. Various embodiments changeable and transformable by those skilled in the art may be considered as being within the scope of the present disclosure without departing from the spirit of the present disclosure specified in the claims.

The invention claimed is:

1. A dehumidifier comprising:

a body including a seating part at an upper portion thereof, and a connection port configured to protrude upward from the seating part; and a water container configured to be seated on the seating part and including a connection hole into which the connection port is inserted, and a valve configured to open the connection hole when the water container is mounted on the body.

2. The dehumidifier of claim 1, wherein the valve includes a valve pipe installed on the connection hole to be vertically movable and provided with a hole into which the connection port is inserted, and the valve pipe includes a valve hole configured to communicate with the inside of the water container when the valve pipe is moved upward in an upper portion thereof.

3. The dehumidifier of claim 1, wherein the valve includes a stopper coupled with an upper end of the valve pipe and configured to restrict downward movement of the valve pipe to a certain level or less, and a hook protrusion configured to extend outward in a radial direction from a lower end of the valve pipe and restrict upward movement of the valve pipe to a certain level or less.

4. The dehumidifier of claim 1, wherein:

the water container includes a water storage portion provided in a lower portion thereof and configured to store condensed water, and a step portion provided in an upper portion of the water container to be stepped on the basis of the water storage portion; and the connection hole is provided in the step portion.

5. The dehumidifier of claim 1, wherein the valve includes a valve portion formed of a material elastically transformed, and wherein the valve portion is elastically transformed by an upper end of the connection port being inserted into the connection hole, and configured to be moved upward.

6. The dehumidifier of claim 5, wherein:

the valve includes a coupler provided with a hole into which the connection port is inserted and coupled to the connection hole of the water container; and the valve portion extends from one side of an upper end of the coupler and covers the hole of the coupler.

* * * * *